US009104160B2

(12) United States Patent
Yotsutsuji

(10) Patent No.: US 9,104,160 B2
(45) Date of Patent: Aug. 11, 2015

(54) IMAGE FORMING APPARATUS THAT ADJUSTS DENSITY OF TONER IMAGE BASED ON REPLACEMENT RATE OF TONER IN DEVELOPING PART AND TONER IN REPLACED CARTRIDGE

(71) Applicant: KYOCERA DOCUMENT SOLUTIONS INC., Osaka (JP)

(72) Inventor: Takefumi Yotsutsuji, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 13/957,240

(22) Filed: Aug. 1, 2013

(65) Prior Publication Data

US 2014/0056602 A1 Feb. 27, 2014

(30) Foreign Application Priority Data

Aug. 21, 2012 (JP) ..... 2012-182696

(51) Int. Cl.

| | |
|---|---|
| ***G03G 15/08*** | (2006.01) |
| ***G03G 15/00*** | (2006.01) |
| ***G03G 15/06*** | (2006.01) |
| *G03G 13/06* | (2006.01) |

(52) U.S. Cl.

CPC ..... *G03G 15/556* (2013.01); *G03G 15/065* (2013.01); *G03G 15/50* (2013.01); *G03G 13/06* (2013.01)

(58) Field of Classification Search

CPC ..... G03G 15/556
USPC ..... 399/43, 44, 55
See application file for complete search history.

(56) References Cited

U.S. PATENT DOCUMENTS

| | | | |
|---|---|---|---|
| 4,912,512 | A | 3/1990 | Midorikawa et al. |
| 8,526,834 | B2 | 9/2013 | Kawai |
| 2001/0016130 | A1* | 8/2001 | Bessho et al. |
| 2001/0028817 | A1* | 10/2001 | Tamura et al. |
| 2001/0051061 | A1* | 12/2001 | Bessho |
| 2012/0027423 | A1 | 2/2012 | Kawai |

FOREIGN PATENT DOCUMENTS

| | | | | |
|---|---|---|---|---|
| JP | 01-232360 | A | | 9/1989 |
| JP | 05019630 | A | * | 1/1993 |
| JP | 2003186354 | A | * | 7/2003 |
| JP | 2012-032462 | A | | 2/2012 |

* cited by examiner

*Primary Examiner* — Walter L Lindsay, Jr.
*Assistant Examiner* — Milton Gonzalez
(74) *Attorney, Agent, or Firm* — Studebaker & Brackett PC

(57) ABSTRACT

An image forming apparatus includes an image carrier, a developing part, a storing part and an adjusting part. The image carrier includes a surface. An electrostatic latent image formed on the surface is developed by a toner, and then, a toner image is formed on the surface. The developing part contains the toner supplied from a toner cartridge and supplies the toner to the image carrier. The storing part stores information relating to a replacement rate when a first toner in the developing part is replaced by a second toner, in a case where kinds of the first toner contained in the developing part and the second toner being supplied from the toner cartridge are different. The adjusting part adjusts density of the toner image on the basis of the replacement rate when a toner cartridge containing the first toner is replaced by another toner cartridge containing the second toner.

6 Claims, 10 Drawing Sheets

FIG. 4

<table>
<tr><td></td><td colspan="10">PRINTING RATE [%]</td></tr>
<tr><td>NUMBER</td><td>10</td><td>20</td><td>30</td><td>40</td><td>50</td><td>60</td><td>70</td><td>80</td><td>90</td><td>100</td></tr>
<tr><td>0</td><td>0</td><td>0</td><td>0</td><td>0</td><td>0</td><td>0</td><td>0</td><td>0</td><td>0</td><td>0</td></tr>
<tr><td>10</td><td>0</td><td>0</td><td>0</td><td>0</td><td>10</td><td>10</td><td>10</td><td>10</td><td>10</td><td>20</td></tr>
<tr><td>20</td><td>0</td><td>0</td><td>0</td><td>10</td><td>20</td><td>20</td><td>20</td><td>20</td><td>20</td><td>40</td></tr>
<tr><td>30</td><td>0</td><td>0</td><td>10</td><td>20</td><td>30</td><td>30</td><td>50</td><td>50</td><td>60</td><td>60</td></tr>
<tr><td>40</td><td>0</td><td rowspan="2">10</td><td>20</td><td>30</td><td>40</td><td>50</td><td>60</td><td>60</td><td>70</td><td>80</td></tr>
<tr><td>50</td><td>0</td><td rowspan="2">30</td><td>40</td><td rowspan="2">60</td><td>60</td><td>70</td><td>80</td><td>90</td><td rowspan="6">100</td></tr>
<tr><td>60</td><td>0</td><td>50</td><td>70</td><td>80</td><td>90</td><td rowspan="5">100</td></tr>
<tr><td>70</td><td>0</td><td>20</td><td rowspan="2">50</td><td rowspan="2">60</td><td>70</td><td>80</td><td>90</td><td rowspan="4">100</td></tr>
<tr><td>80</td><td>0</td><td>30</td><td>80</td><td>90</td><td rowspan="3">100</td></tr>
<tr><td>90</td><td>10</td><td rowspan="2">40</td><td rowspan="2">60</td><td>70</td><td>90</td><td rowspan="2">100</td></tr>
<tr><td>100</td><td>20</td><td>80</td><td>100</td></tr>
</table>

FIG. 5

| | | TEMPERATURE | | | | | | | |
|---|---|---|---|---|---|---|---|---|---|
| | | ～15 | 16～20 | 21～24 | 25～27 | 28～30 | 31～33 | 34～36 | 37～ |
| HUMIDITY | ～35 | ×0.8 | ×0.8 | ×0.8 | ×1.0 | ×1.0 | ×1.0 | ×1.0 | ×1.0 |
| | 36～45 | ×0.8 | ×0.8 | ×0.8 | ×1.0 | ×1.0 | ×1.0 | ×1.0 | ×1.0 |
| | 46～55 | ×0.8 | ×0.8 | ×0.8 | ×1.0 | ×1.0 | ×1.0 | ×1.0 | ×1.2 |
| | 56～65 | ×0.8 | ×0.8 | ×1.0 | ×1.0 | ×1.0 | ×1.0 | ×1.2 | ×1.2 |
| | 66～75 | ×0.8 | ×1.0 | ×1.0 | ×1.0 | ×1.0 | ×1.2 | ×1.2 | ×1.2 |
| | 76～ | ×1.0 | ×1.0 | ×1.0 | ×1.0 | ×1.2 | ×1.2 | ×1.2 | ×1.2 |

FIG. 6

| T/C | CORRECTION VALUE |
|---|---|
| ～6 | ×0.8 |
| 7～9 | ×1.0 |
| 10～12 | ×1.0 |
| 12～ | ×1.2 |

FIG. 7

<table>
<tr><th></th><th colspan="10">PRINTING RATE [%]</th></tr>
<tr><th>NUMBER</th><th>10</th><th>20</th><th>30</th><th>40</th><th>50</th><th>60</th><th>70</th><th>80</th><th>90</th><th>100</th></tr>
<tr><td>0</td><td>0</td><td>0</td><td>0</td><td>0</td><td>0</td><td>0</td><td>0</td><td>0</td><td>0</td><td>0</td></tr>
<tr><td>10</td><td>0</td><td>0</td><td>0</td><td>0</td><td>10</td><td>10</td><td>10</td><td>10</td><td>10</td><td>20</td></tr>
<tr><td>20</td><td>0</td><td>0</td><td>0</td><td>10</td><td>20</td><td>20</td><td>20</td><td>20</td><td>20</td><td>40</td></tr>
<tr><td>30</td><td>0</td><td>0</td><td>10</td><td>20</td><td>30</td><td>30</td><td rowspan="2">50</td><td rowspan="2">50</td><td>50</td><td>50</td></tr>
<tr><td>40</td><td>0</td><td rowspan="3">10</td><td>20</td><td>30</td><td>40</td><td rowspan="2">50</td><td>40</td><td>30</td></tr>
<tr><td>50</td><td>0</td><td rowspan="2">30</td><td>40</td><td rowspan="2">50</td><td>40</td><td>30</td><td>20</td><td rowspan="5">10</td></tr>
<tr><td>60</td><td>0</td><td rowspan="3">50</td><td>40</td><td>30</td><td>20</td><td rowspan="4">10</td></tr>
<tr><td>70</td><td>0</td><td>20</td><td rowspan="4">50</td><td>40</td><td>30</td><td>20</td><td rowspan="4">10</td></tr>
<tr><td>80</td><td>0</td><td>30</td><td>30</td><td>20</td><td rowspan="3">10</td></tr>
<tr><td>90</td><td>10</td><td rowspan="2">40</td><td>40</td><td>20</td><td rowspan="2">10</td></tr>
<tr><td>100</td><td>20</td><td>30</td><td>10</td></tr>
</table>

FIG. 9

| | PRINTING RATE [%] | | | | | | | | | |
|---|---|---|---|---|---|---|---|---|---|---|
| NUMBER | 10 | 20 | 30 | 40 | 50 | 60 | 70 | 80 | 90 | 100 |
| 0 | 0 | 0 | 0 | 0 | 0 | 0 | 0 | 0 | 0 | 0 |
| 10 | 0 | 0 | 0 | 0 | 0.5 | 0.5 | 0.5 | 0.5 | 0.5 | 1 |
| 20 | 0 | 0 | 0 | 0.5 | 1 | 1 | 1 | 1 | 1 | 2 |
| 30 | 0 | 0 | 0.5 | 1 | 1.5 | 1.5 | 2.5 | 2.5 | 2.5 | 2.5 |
| 40 | 0 | 0.5 | 1 | 1.5 | 2 | 2.5 | | | 2 | 1.5 |
| 50 | 0 | | 1.5 | 2 | 2.5 | | 2 | 1.5 | 1 | 0.5 |
| 60 | 0 | | | 2.5 | | 2 | 1.5 | 1 | 0.5 | |
| 70 | 0 | 1 | 2.5 | | 2 | 1.5 | 1 | 0.5 | | |
| 80 | 0 | 1.5 | | | 1.5 | 1 | 0.5 | | | |
| 90 | 0.5 | 2 | | 2 | 1 | 0.5 | | | | |
| 100 | 1 | | | 1.5 | 0.5 | | | | | |

IMAGE FORMING APPARATUS THAT ADJUSTS DENSITY OF TONER IMAGE BASED ON REPLACEMENT RATE OF TONER IN DEVELOPING PART AND TONER IN REPLACED CARTRIDGE

INCORPORATION BY REFERENCE

This application is based on and claims the benefit of priority from Japanese Patent application No. 2012-182696 filed on Aug. 21, 2012, the entire contents of which are incorporated herein by reference.

BACKGROUND

The present disclosure relates to an image forming apparatus forming an image to a substance to be transferred by using a toner.

As an image forming apparatus, such a printer, a copying machine or a multifunction machine, there is the image forming apparatus forming an image to a substance to be transferred by using a toner. In the image forming apparatus, a toner cartridge is generally replaced so that the toner of the same kind is used. However, in the image forming apparatus, another toner cartridge containing another toner with compatibility instead of a standard toner is often installed to use the other toner. In that case, in the image forming apparatus, if a characteristic, such as an electric charge amount, is different between the standard toner and the other toner, a characteristic relating to development of a development device varies. Therefore, there is an image forming apparatus applying process condition suited to the standard toner when a mixture rate between the standard toner and other toner is fifty percent or less, but applying other process condition suited to the other toner when the mixture rate exceeds fifty percent.

Thus, the above-mentioned image forming apparatus changes the process condition according to whether or not the mixture rate between the standard toner and other toner exceeds fifty percent. However, according to the mixture rate between the standard toner and other toner, the characteristic relating to the development usually varies. Therefore, in the image forming apparatus, by being based on the mixture rate of fifty percent, there is a possibility that an image quality of the image formed on a sheet becomes instability.

SUMMARY

In accordance with an embodiment of the present disclosure, an image forming apparatus includes an image carrier, a developing part, a storing part and an adjusting part. The image carrier includes a surface, an electrostatic latent image formed on the surface is developed by a toner, and then, a toner image is formed on the surface. The developing part contains the toner supplied from a toner cartridge and supplies the contained toner to the image carrier. The storing part stores information relating to a replacement rate of a replaced toner when a first toner contained in the developing part is replaced by a second toner in a case where kinds of the first toner as a toner contained in the developing part and the second toner as another toner being supplied from the toner cartridge are different from each other. The adjusting part adjusts density of the toner image on the basis of the replacement rate stored in the storing part when a toner cartridge containing the first toner is replaced by another toner cartridge containing the second toner.

The above and other objects, features, and advantages of the present disclosure will become more apparent from the following description when taken in conjunction with the accompanying drawings in which a preferred embodiment of the present disclosure is shown by way of illustrative example.

BRIEF DESCRIPTION OF THE DRAWINGS

FIG. 4 is a table showing as an example a replacement rate according to a printing rate and the number of sheets on which an image has been formed.

FIG. 5 is a table showing as an example a correction value of the replacement rate according to temperature and humidity.

FIG. 6 is a table showing as an example a correction value of the replacement rate according to a ratio (a T/C ratio) of a toner to a carrier.

FIG. 7 is a table showing as an example an adjustment value of a development bias.

FIG. 9 is a table showing as an example an adjustment value of the T/C ratio.

DETAILED DESCRIPTION

Figure 1:
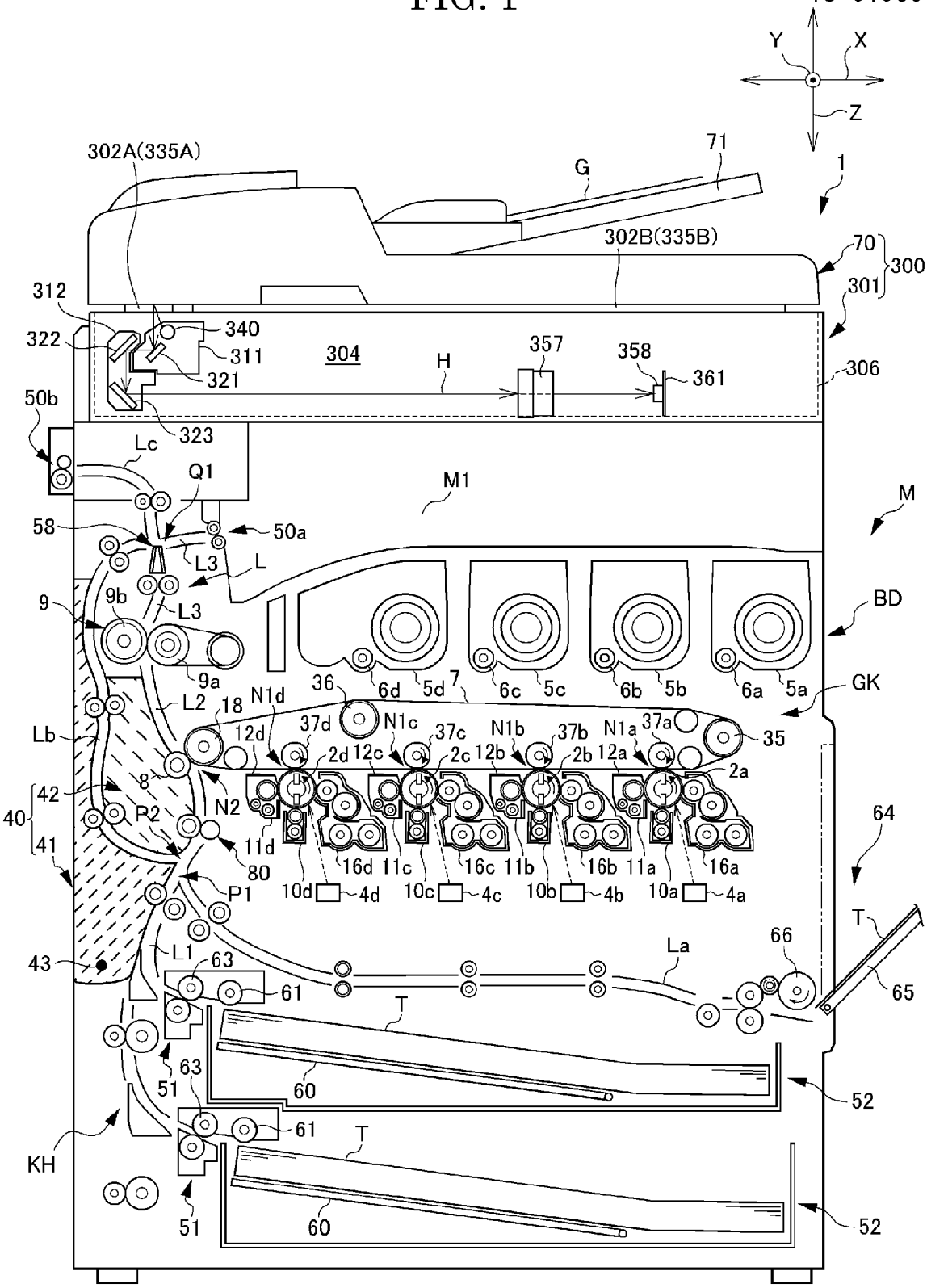
FIG. 1 is a schematic diagram schematically showing arrangement of components in a copying machine according to an embodiment of the present disclosure.

In the following, an embodiment of an image forming apparatus of the present disclosure will be described with reference to the drawings. With reference to FIG. 1, an entire configuration of a copying machine 1 as the image forming apparatus of the embodiment will be described. FIG. 1 is a diagram used for explaining arrangement of components in the copying machine 1.

As shown in FIG. 1, the copying machine 1 as the image forming apparatus includes an image reading device 300 and an apparatus main body M. The image reading device 300 is located at an upper side in upper and lower direction Z in the copying machine 1. The apparatus main body M is located at a lower side in the upper and lower direction Z in the copying machine 1 and forms a toner image to a sheet T as a sheet-liked substance to be transferred on the basis of image information read by the image reading device 300. In the description about the copying machine 1, a sub scanning direction X is often called as a "left and right directions" of the copying machine 1 and a main scanning direction Y (a direction perpendicular to a paper surface of FIG. 1) is often called as a "forward and backward directions" of the copying machine 1. The upward and downward directions Z of the copying machine 1 cross the sub scanning direction X and main scanning direction Y at right angles.

First, the image reading device 300 will be described. As shown in FIG. 1, the image reading device 300 includes a reading part 301 and a document conveying part 70. The reading part 301 reads an image of a document G. The document conveying part 70 is located at an upper side of the reading part 301 and conveys the document G to the reading part 301.

The reading part 301 includes a housing 306, and a first reading face 302A and a second reading face 302B located at an upper side of the housing 306. The reading part 301 also includes, in an internal space 304 of the housing 306, a lighting part 340 having a light source, a plurality of mirrors 321, 322 and 323, and a first frame body 311 and a second frame body 312 moving in the sub scanning direction X. The lighting part 340 and first mirror 321 are installed in the first frame body 311. The second mirror 322 and third mirror 323 are installed in the second frame body 312. Moreover, in the internal space 304 of the housing 306, an imaging lens 357, a CCD (Charge Coupled Device) 358 as a reader and a CCD circuit board 361 are provided. The CCD circuit board 361 carries out a predetermined process to image information read by the CCD 358 and outputs the image information to a side of the apparatus main body M.

The document conveying part 70 is openably/closably connected to the reading part 301 by a connect part (not shown). The document conveying part 70 includes a document placement part 71 at an upper side and a feed roller (not shown) inside. The document conveying part 70 also has a function of protecting the first reading face 302A and second reading face 302B of the reading part 301.

The first reading face 302A is a reading face used in a case of reading the document G conveyed by the document conveying part 70. The first reading face 302A is formed along an upper face of a first contact glass 335A on which the document G is conveyed. The first reading face 302A is positioned near a left side face of the housing 306. This position shown in FIG. 1 is often called as a "first reading position".

The second reading face 302B is another reading face used in another case of reading the document G without using the document conveying part 70. The second reading face 302B is formed along an upper face of a second contact glass 335B on which the document G is placed. The second reading face 302B is located at the right side of the first reading face 302A over the great part in the sub scanning direction X of the reading part 301. The first reading face 302A and second reading face 302B are extended in a direction crossing the sub scanning direction X and main scanning direction Y at right angles.

When the document G conveyed by the document conveying part 70 is read, the document G is placed on the document placement part 71. The document G placed on the document placement part 71 is conveyed on the first reading face 302A of the reading part 301 by the feed roller provided inside the document conveying part 70. In this case, the first frame body 311 and second frame body 312 are positioned at the first reading position, but not moved. As the document G is conveyed so as to slide on the first reading face 302A by the document conveying part 70, an image formed on a surface of the document G is read by the CCD 358 as a reading device.

On the other hand, when the document conveying part 70 is in an opening state, the document G is placed on the second reading face 302B. In this case, the first frame body 311 and second frame body 312 are moved in the sub scanning direction X with keeping a length (an optical path length) of an optical path H mentioned below constant. Thereby, the image of the document G placed on the second reading face 302B is read.

In the internal space 304 of the housing 306, the plurality of the mirrors 321, 322 and 323 make the optical path H bringing an incident light from the document G to the imaging lens 357. Because the first frame body 311 is moved in the sub scanning direction X at a predetermined speed A and the second frame body 312 is moved in the sub scanning direction X at another predetermined speed A/2, the length of the optical path H is kept constant in an image reading operation. The reading part 301 will be described in detail as follows.

Next, the apparatus main body M will be described. The apparatus main body M includes an image forming part GK and a sheet feeding/ejecting part KH. The image forming part GK forms a given toner image on the sheet T on the basis of given image information. The sheet feeding/ejecting part KH feeds the sheet T to the image forming part GK and ejects the sheet T on which the toner image is formed. An outer shape of the apparatus main body M is formed by a case body BD as a housing.

As shown in FIG. 1, the image forming part GK includes photosensitive drums 2*a*, 2*b*, 2*c* and 2*d* as image carriers (photosensitive members), chargers 10*a*, 10*b*, 10*c* and 10*d*, laser scanning units 4*a*, 4*b*, 4*c* and 4*d* as exposure units, development devices 16*a*, 16*b*, 16*c* and 16*d*, toner cartridges 5*a*, 5*b*, 5*c* and 5*d*, toner supply parts 6*a*, 6*b*, 6*c* and 6*d*, drum cleaning parts 11*a*, 11*b*, 11*c* and 11*d*, static eliminators 12*a*, 12*b*, 12*c* and 12*d*, an intermediate transferring belt 7, first transfer rollers 37*a*, 37*b*, 37*c* and 37*d*, a second transfer roller 8, a facing roller 18 and a fixing part 9.

As shown in FIG. 1, the sheet feeding/ejecting part KH includes sheet feeding cartridges 52, a manual bypass sheet feeding part 64, a conveying path L for the sheet T, a pair of registration rollers 80, a first sheet ejecting part 50*a* and a second sheet ejecting part 50*b*. The conveying path L is aggregate of a first conveying path L1, a second conveying path L2, a third conveying path L3, a manual bypass conveying path La, a return conveying path Lb and a post-process conveying path Lc mentioned below.

In the following, the configurations of the image forming part GK and sheet feeding/ejecting part KH will be described in detail. First, the image forming part GK will be described. The image forming part GK carries out, along surfaces of the photosensitive drums 2*a*, 2*b*, 2*c* and 2*d* in order from an upper stream side to a lower stream side, electrical charges by the chargers 10*a*, 10*b*, 10*c* and 10*d*, exposures by the laser scanning units 4*a*, 4*b*, 4*c* and 4*d*, development by the development devices 16*a*, 16*b*, 16*c* and 16*d*, first transfers by the intermediate transferring belt 7 and first transfer rollers 37*a*, 37*b*, 37*c* and 37*d*, static eliminations by the static eliminators 12*a*, 12*b*, 12*c* and 12*d*, and cleaning by the drum cleaning parts 11*a*, 11*b*, 11*c* and 11*d*, respectively. The image forming part GK also carries out second transfer by the intermediate transferring belt 7, second transfer roller 8 and facing roller 18, and fixation by the fixing part 9.

The photosensitive drums 2*a*, 2*b*, 2*c* and 2*d* are formed by respective cylinder-liked members and function as photosensitive members or image carriers. The photosensitive drums 2*a*, 2*b*, 2*c* and 2*d* are located so as to rotate in a direction indicated by an arrow in the figure around respective rotation axes extending in a direction crossing a forward direction of the intermediate transferring belt 7 at right angles. On the surfaces of the photosensitive drums 2*a*, 2*b*, 2*c* and 2*d*, an electrostatic latent image can be formed. That is, in the photosensitive drums 2*a*, 2*b*, 2*c* and 2*d*, the electrostatic latent images formed on the respective surfaces are developed by toners (developers), thereby toner images are formed on the respective surfaces.

The chargers 10*a*, 10*b*, 10*c* and 10*d* are respectively located facing to the surfaces of the photosensitive drums 2*a*, 2*b*, 2*c* and 2*d*. The chargers 10*a*, 10*b*, 10*c* and 10*d* charge the respective surfaces of the photosensitive drums 2*a*, 2*b*, 2*c* and 2*d* to uniform negative electricity (minus polarity) or positive electricity (plus polarity).

The laser scanning units 4*a*, 4*b*, 4*c* and 4*d* function as respective exposure units and are respectively located apart from the surfaces of the photosensitive drums 2*a*, 2*b*, 2*c* and 2*d*. Each of the laser scanning units 4*a*, 4*b*, 4*c* and 4*d* is configured to have a laser light source, a polygon mirror, a polygon mirror driving motor and other components (not shown).

The laser scanning units 4*a*, 4*b*, 4*c* and 4*d* respectively scan and expose the surfaces of the photosensitive drums 2*a*, 2*b*, 2*c* and 2*d* on the basis of the image information relating to the image read by the reading part 301. By the scans and exposures of the respective laser scanning units 4*a*, 4*b*, 4*c* and 4*d*, electrical charges on the exposed parts of the surfaces of the photosensitive drums 2*a*, 2*b*, 2*c* and 2*d* are respectively eliminated. Thereby, the electrostatic latent images are formed on the respective surfaces of the photosensitive drums 2*a*, 2*b*, 2*c* and 2*d*.

The development devices 16*a*, 16*b*, 16*c* and 16*d* as developing parts contain the toner supplied from the toner cartridges 5*a*, 5*b*, 5*c* and 5*d* and supply the contained toner to the photosensitive drums 2*a*, 2*b*, 2*c* and 2*d*. That is, the development devices 16*a*, 16*b*, 16*c* and 16*d* respectively correspond to the photosensitive drums 2*a*, 2*b*, 2*c* and 2*d* and are located facing to the surfaces of the photosensitive drums 2*a*, 2*b*, 2*c* and 2*d*. The development devices 16*a*, 16*b*, 16*c* and 16*d* respectively apply respective color toners to the electrostatic latent images formed on the surfaces of the photosensitive drums 2*a*, 2*b*, 2*c* and 2*d* to form respective color toner images on the surfaces of the photosensitive drums 2*a*, 2*b*, 2*c* and 2*d*. The development devices 16*a*, 16*b*, 16*c* and 16*d* also respectively correspond to four colors of yellow, cyan, magenta and black. Each of the development devices 16*a*, 16*b*, 16*c* and 16*d* is configured to have a developing roller located facing to the surface of the photosensitive drum 2*a*, 2*b*, 2*c* or 2*d*, a stirring roller stirring the toner and other components. The development devices 16*a*, 16*b*, 16*c* and 16*d* will be described in detail as follows.

The toner cartridges 5*a*, 5*b*, 5*c* and 5*d* respectively correspond to the development devices 16*a*, 16*b*, 16*c* and 16*d* and contain the respective color toners supplied to the development devices 16*a*, 16*b*, 16*c* and 16*d*. The toner cartridges 5*a*, 5*b*, 5*c* and 5*d* respectively contain yellow toner, cyan toner, magenta toner and black toner.

The toner supply parts 6 (6*a*, 6*b*, 6*c* and 6*d*) respectively correspond to the toner cartridges 5*a*, 5*b*, 5*c* and 5*d* and development devices 16*a*, 16*b*, 16*c* and 16*d*, and supply the respective color toners contained in the toner cartridges 5*a*, 5*b*, 5*c* and 5*d* to the development devices 16*a*, 16*b*, 16*c* and 16*d*. The toner supply parts 6*a*, 6*b*, 6*c* and 6*d* are respectively connected to the development devices 16*a*, 16*b*, 16*c* and 16*d* by toner supply paths (not shown).

To the intermediate transferring belt 7, the respective color toner images formed on the photosensitive drums 2*a*, 2*b*, 2*c* and 2*d* are first-transferred in sequence. The intermediate transferring belt 7 is wound around a following roller 35, the facing roller 18 as a driving roller and a tension roller 36. Because the tension roller 36 biases the intermediate transferring belt 7 from the inside to the outside, given tensile strength is added to the intermediate transferring belt 7.

At the opposite sides of the photosensitive drums 2*a*, 2*b*, 2*c* and 2*d* across the intermediate transferring belt 7, the first transfer rollers 37*a*, 37*b*, 37*c* and 37*d* are respectively located facing to the photosensitive drums 2*a*, 2*b*, 2*c* and 2*d*.

Given parts of the intermediate transferring belt 7 are held between the first transfer rollers 37*a*, 37*b*, 37*c* and 37*d* and photosensitive drums 2*a*, 2*b*, 2*c* and 2*d*. The held parts are respectively pressed to the surfaces of the photosensitive drums 2*a*, 2*b*, 2*c* and 2*d*. Between the photosensitive drums 2*a*, 2*b*, 2*c* and 2*d* and first transfer rollers 37*a*, 37*b*, 37*c* and 37*d*, first transfer nips N1*a*, N1*b*, N1*c* and N1*d* are respectively formed. In the first transfer nips N1*a*, N1*b*, N1*c* and N1*d*, the respective color toner images developed to the photosensitive drums 2*a*, 2*b*, 2*c* and 2*d* are first-transferred to the intermediate transferring belt 7 in sequence. Thereby, a full color toner image is formed to the intermediate transferring belt 7.

To the respective first transfer rollers 37*a*, 37*b*, 37*c* and 37*d*, a first transfer bias applying part (not shown) applies respective first transfer biases which are used for transferring the respective color toner images formed on the photosensitive drums 2*a*, 2*b*, 2*c* and 2*d* to the intermediate transferring belt 7.

The static eliminators 12*a*, 12*b*, 12*c* and 12*d* are respectively located facing to the surfaces of the photosensitive drums 2*a*, 2*b*, 2*c* and 2*d*. The static eliminators 12*a*, 12*b*, 12*c* and 12*d* irradiate the respective surfaces of the photosensitive drums 2*a*, 2*b*, 2*c* and 2*d* with lights to static-eliminate the first-transferred surfaces of the photosensitive drums 2*a*, 2*b*, 2*c* and 2*d* (to remove the electrical charges).

The drum cleaning parts 11*a*, 11*b*, 11*c* and 11*d* are respectively located facing to the surfaces of the photosensitive drums 2*a*, 2*b*, 2*c* and 2*d*. The drum cleaning parts 11*a*, 11*b*, 11*c* and 11*d* respectively remove toners and deposits remained on the surfaces of the photosensitive drums 2*a*, 2*b*, 2*c* and 2*d* and convey the removed toners and the like to a predetermined collecting mechanism to collect those.

The second transfer roller 8 second-transfers the full color toner image first-transferred on the intermediate transferring belt 7 to the sheet T. To the second transfer roller 8, a second transfer bias applying part (not shown) applies a second transfer bias which is used for transferring the full color toner image formed on the intermediate transferring belt 7 to the sheet T.

The second transfer roller 8 comes into contact with and separates from the intermediate transferring belt 7. Concretely, the second transfer roller 8 is configured to move between a contact position coming into contact with the intermediate transferring belt 7 and a separate position separating from the intermediate transferring belt 7. In detail, the second transfer roller 8 is located at the contact position when the full color toner image first-transferred on the surface of the intermediate transferring belt 7 is second-transferred to the sheet T, but located at the separate position otherwise.

At the opposite sides of the second transfer roller 8 across the intermediate transferring belt 7, the facing roller is located. Another given part of the intermediate transferring belt 7 is held between the second transfer roller 8 and facing roller 18. The sheet T is pressed to an outer face (a face on which the toner image is first-transferred) of the intermediate transferring belt 7. Between the intermediate transferring belt 7 and second transfer roller 8, a second transfer nip N2 is formed. In the second transfer nip N2, the full color toner image first-transferred to the intermediate transferring belt 7 is second-transferred to the sheet T.

The fixing part 9 melts and pressurizes the color toners forming the toner image second-transferred on the sheet T to fix color toners to the sheet T. The fixing part 9 includes a heating rotation member 9*a* heated by a heater and a pressurizing rotation member 9*b* pressurized to the heating rotation member 9*a*. The heating rotation member 9*a* and pressurizing rotation member 9*b* hold, pressurize and convey the sheet T on which the toner image is second-transferred. By conveying the sheet T in a state held between the heating rotation member 9*a* and pressurizing rotation member 9*b*, the toner transferred on the sheet T is melted and pressurized, and thereby, fixed on the sheet T.

Next, the sheet feeding/ejecting part KH will be described. As shown in FIG. 1, in a lower part of the apparatus main body M, two sheet feeding cartridges 52 storing the sheet Tare located so as to be vertically arranged. Each sheet feeding cartridges 52 is configured so as to be horizontally pulled out from the housing of the apparatus main body M. In the sheet feeding cartridge 52, a placement board 60 on which the sheet T is placed is located. In the sheet feeding cartridge 52, the sheet T is stored in a state piled on the placement board 60. The sheet T placed on the placement board 60 is fed to the conveying path L by a cartridge sheet feeding part 51 located to an end part (an end part at the left side in FIG. 1) at a sheet feeding side of the sheet feeding cartridge 52. The cartridge sheet feeding part 51 includes a double-feeding preventive mechanism composed of a forward feeding roller 61 picking up the sheet T on the placement board 60 and a pair of sheet feeding rollers 63 feeding the sheet T to the conveying path L one by one.

In a right side face (the right side in FIG. 1) of the apparatus main body M, the manual bypass sheet feeding part 64 is located. The manual bypass sheet feeding part 64 is provided as a main purpose of feeding the apparatus main body M with another sheet T with different size or type from the sheet T set to the sheet feeding cartridge 52. The manual bypass sheet feeding part 64 includes a manual bypass tray 65 forming a part of the right side face of the apparatus main body Min a closing state and a sheet feeding roller 66. The manual bypass tray 65 has a lower end turnably (openably/closably) attached to the apparatus main body M near the sheet feeding roller 66. On the manual bypass tray 65 in an opening state, the other sheet T is placed. The sheet feeding roller 66 feeds the other sheet T placed on the manual bypass tray 65 in the opening state to the manual bypass conveying path La.

In an upper side of the apparatus main body M, the first sheet ejecting part 50*a* and second sheet ejecting part 50*b* are located. The first sheet ejecting part 50*a* and second sheet ejecting part 50*b* eject the sheet T outside the apparatus main body M. The first sheet ejecting part 50*a* and second sheet ejecting part 50*b* will be described in detail as follows.

The conveying path L conveying the sheet T includes the first conveying path L1, second conveying path L2, third conveying path L3, manual bypass conveying path La, return conveying path Lb and post-process conveying path Lc. The first conveying path L1 conveys the sheet T from the cartridge sheet feeding part 51 to the second transfer nip N2. The second conveying path L2 conveys the sheet T from the second transfer nip N2 to the fixing part 9. The third conveying path L3 conveys the sheet T from the fixing part 9 to the first sheet ejecting part 50*a*. The manual bypass conveying path La is joined to the first conveying path L1 to convey the sheet fed from the manual bypass sheet feeding part 64 to the first conveying path L1. The return conveying path Lb inverts the sheet conveyed from an upper stream side to a lower stream side in the third conveying path L3 and returns the sheet to the first conveying path L1. The post-process conveying path Lc conveys the sheet conveyed from the upper stream side to the lower stream side in the third conveying path L3 to a post-process device (not shown) connected to the second sheet ejecting part 50*b*.

In the middle of the first conveying path L1, a first junction part P1 and a second junction part P2 are located. In the middle of the third conveying path L3, a first branch part Q1 is located. The first junction part P1 is a junction part of joining the manual bypass conveying path La to the first conveying path L1. The second junction part P2 is another junction part of joining the return conveying path Lb to the first conveying path L1. The first branch part Q1 is a branch part of having the post-process conveying path Lc branched from the third conveying path L3. The first branch part Q1 includes a rectification member 58. The rectification member 58 rectifies (switches) a conveyance direction of the sheet T conveyed from the fixing part 9 to the third conveying path L3 toward the first sheet ejecting part 50*a* or the post-process conveying path Lc toward the second sheet ejecting part 50*b*.

In the middle (in detail, between the second junction part P2 and second transfer roller 8) of the first conveying path L1, a sensor detecting the sheet T and the pair of registration rollers 80 are located. The pair of registration rollers 80 carries out skew (oblique sheet feeding) correction of the sheet T or adapts a timing of conveying the sheet T to an operation of forming the toner image by the image forming part GK. The sensor is located immediately before the pair of registration rollers 80 in the conveyance direction of the sheet T (at an upper stream side of the conveyance direction). The pair of registration rollers 80 are a pair of rollers carrying out the above-mentioned correction and timing adaption and conveying the sheet T on the basis of detection signal information from the sensor.

The return conveying path Lb is a conveying path provided for facing a reverse face (a non-print face) of an already printed face to the intermediate transferring belt 7 when a duplex printing is performed to the sheet T. The return conveying path Lb can invert the sheet T conveyed from the first branch part Q1 to a side of a sheet ejecting part 50 (the first sheet ejecting part 50*a* and second sheet ejecting part 50*b*) and return the sheet T to the first conveying path L1, and then, convey the sheet T to an upper stream side of the pair of registration rollers 80 located at the upper stream side of the second transfer roller 8. The sheet T inverted by the return conveying path Lb is treated by the second transfer nip N2 so that the given toner image is transferred to the non-print face.

At an end part of the third conveying path L3, the first sheet ejecting part 50*a* is provided. The first sheet ejecting part 50*a* is located at the upper side of the apparatus main body M. The first sheet ejecting part 50*a* is opened to a right face side (the right side, e.g. a side of the manual bypass sheet feeding part 64, in FIG. 1) of the apparatus main body M. The first sheet ejecting part 50*a* ejects the sheet T conveyed in the third conveying path L3 outside the apparatus main body M.

At an opened side of the first sheet ejecting part 50*a*, an ejected sheet accumulation part M1 is arranged. The ejected sheet accumulation part M1 is provided in an upper face (an outer face) of the apparatus main body M. The ejected sheet accumulation part M1 is formed by downwardly hollowing a part of the upper face of the apparatus main body M. A bottom face of the ejected sheet accumulation part M1 forms a part of the upper face of the apparatus main body M. In the ejected sheet accumulation part M1, the sheet T with the given toner image ejected from the first sheet ejecting part 50*a* is piled and accumulated.

At an end part of the post-process conveying path Lc, the second sheet ejecting part 50*b* is provided. The second sheet ejecting part 50*b* is located at the upper side of the apparatus main body M. The second sheet ejecting part 50*b* is opened to a left face side (the left side, e.g. a side to which the post-process device is connected, in FIG. 1) of the apparatus main body M. The second sheet ejecting part 50*b* ejects the sheet T conveyed in the post-process conveying path Lc outside the apparatus main body M. To an opened side of the second sheet ejecting part 50*b*, the post-process device (not shown) is connected. The post-process device carries out post-processes (stapling, punching and the others) of the sheet ejected from the image forming apparatus (the copying machine 1). In a predetermined position of each conveying path, a sensor detecting the sheet may be located.

Next, a structure solving a paper jam (JAM) in the main conveying paths L1-L3 (hereinafter, the first conveying path L1, second conveying path L2 and third conveying path L3 are often called as a "main conveying path" in a lump) and return conveying path Lb will be simply described. As shown in FIG. 1, at the left face side (the left side in FIG. 1) of the apparatus main body M, the main conveying paths L1-L3 and return conveying path Lb are arranged so as to extend mainly in the upward and downward directions. At the left face side (the left side in FIG. 1) of the apparatus main body M, a cover body 40 is provided so as to form a part of a side face of the apparatus main body M. The cover body 40 has a lower end part connected to the apparatus main body M via a supporting axis 43. The supporting axis 43 is provided so that the axis direction runs along a direction traversing the main conveying paths L1-L3 and return conveying path Lb. The cover body 40 is configured to turn between a closing position (a position shown in FIG. 1) and an opening position (not shown) around the supporting axis 43.

The cover body 40 includes a first cover part 41 turnably connected to the apparatus main body M by the supporting axis 43 and a second cover part 42 turnably connected to the apparatus main body M by the same supporting axis 43. The first cover part 41 is located at the outer side of the second cover part 42 (a side near the side face) in the apparatus main body M. In FIG. 1, a hatching part indicated by a broken line lowering to the left is the first cover part 41 and another hatching part indicated by another broken line lowering to the right is the second cover part 42.

In a state of the cover body 40 positioning at the closing position, an outer face side of the first cover part 41 forms a part of the outer face (the side face) of the apparatus main body M. In addition, in the state of the cover body 40 positioning at the closing position, an internal face side (an inward side of the apparatus main body M) of the second cover part 42 forms apart of the main conveying paths L1-L3. Moreover, in the state of the cover body 40 positioning at the closing position, an internal face side of the first cover part 41 and an outer face side of the second cover part 42 form at least a part of the return conveying path Lb. That is, the return conveying path Lb is formed between the first cover part 41 and second cover part 42.

Because the copying machine 1 of the embodiment includes the above configured cover body 40, when the paper jam (JAM) is occurred in the main conveying paths L1-L3, by turning the cover body 40 from the closing position shown in FIG. 1 to the opening position (not shown) to open the main conveying paths L1-L3, it is possible to deal with the sheet jammed in the main conveying paths L1-L3. On the other hand, when the paper jam is occurred in the return conveying path Lb, by turning the cover body 40 to the opening position and turning the second cover part 42 to the inward side of the apparatus main body M (the right side in FIG. 1) around the supporting axis 43 to open the return conveying path Lb, it is possible to deal with the sheet jammed in the return conveying path Lb.

Figure 2:
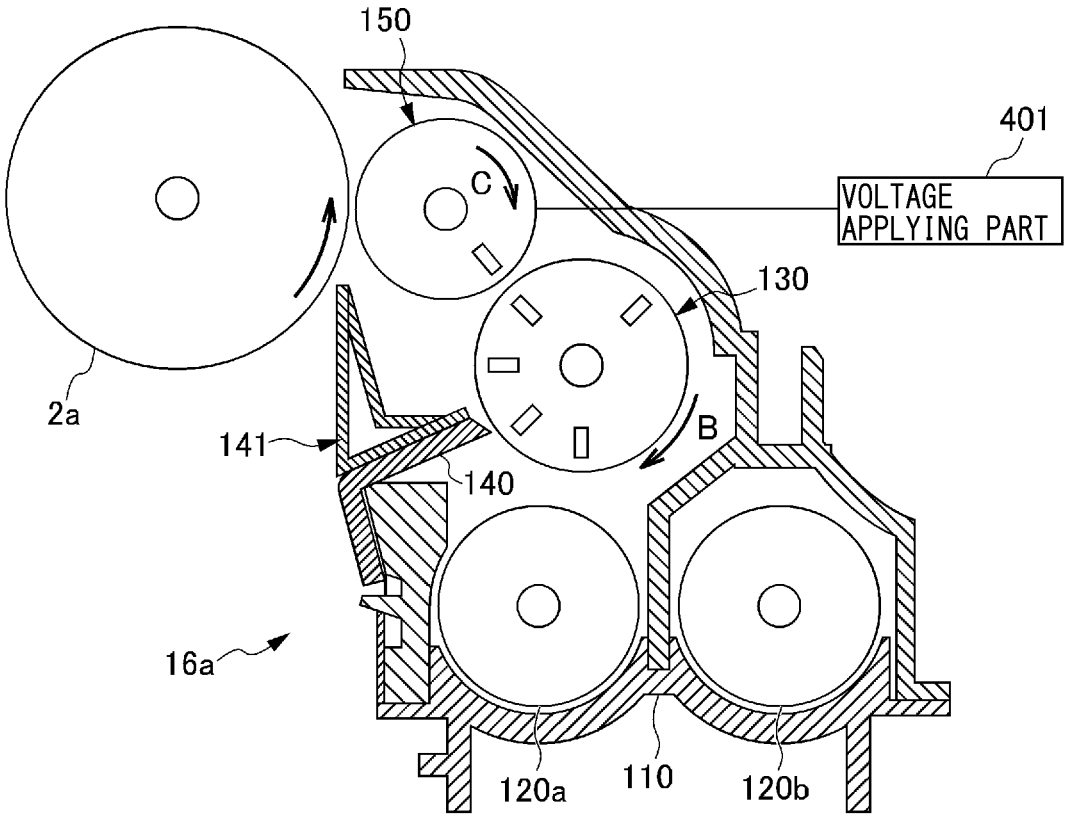
FIG. 2 is a sectional view schematically showing a development device and a photosensitive drum.

Next, the development device will be described. Although the copying machine 1 includes four development devices 16*a*, 16*b*, 16*c* and 16*d*, because these have similar configurations, hereinafter, the development device 16*a* will be representatively described. FIG. 2 is a figure used for explaining the development device 16*a* and photosensitive drum 2*a*.

As shown in FIG. 2, the development device 16*a* includes a development case 110 containing the toner, stirring rollers 120*a* and 120*b*, a magnetic roller 130, a layer thickness adjusting blade 140, a scattered toner capturing cover 141, a developing roller 150 and a voltage applying part 401. The stirring rollers 120*a* and 120*b* are located inside the development case 110. The magnetic roller 130 is located above one stirring roller 120*a* in a vertical direction. The layer thickness adjusting blade 140 is located near the magnetic roller 130. The scattered toner capturing cover 141 is located above the layer thickness adjusting blade 140 in the vertical direction. The developing roller 150 is located facing to the magnetic roller 130.

To the development case 110, the toner is supplied from the toner cartridge 5*a* (refer to FIG. 1) via the toner supply part 6*a* (refer to FIG. 1). The stirring rollers 120*a* and 120*b* stir the toner contained in the development case 110. The magnetic roller 130 supplies the stirred toner to the developing roller 150.

The layer thickness adjusting blade 140 has a top end part facing to and coming into contact with a surface of the magnetic roller 130 to adjust layer thickness (height) of the toner held on the surface of the magnetic roller 130 and to keep the layer thickness constant. The scattered toner capturing cover 141 is a member forming a part of the case body of the development device 16*a*. The scattered toner capturing cover 141 is located above the layer thickness adjusting blade 140 to restrain the toner from scattering outside the development device 16*a*. On a surface of the developing roller 150, the toner supplied from the magnetic roller 130 is carried and a toner layer is formed. To the developing roller 150, bias voltage superimposed direct current or alternating current is applied by the voltage applying part 401. In the developing roller 150, by applying the bias voltage, the toner carried on the surface is moved to the photosensitive drum 2*a* to develop the electrostatic latent image formed on the photosensitive drum 2*a*.

Figure 3:
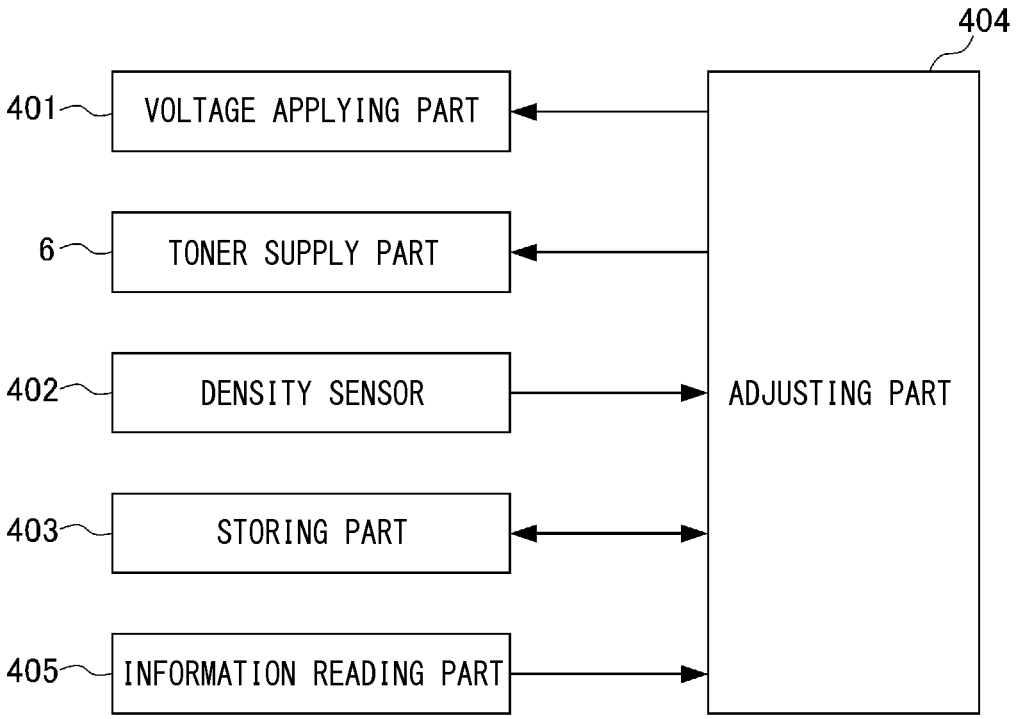
FIG. 3 is a block diagram schematically showing a functional configuration of a distinctive part of the copying machine.

Next, a configuration of a distinctive part of the copying machine 1 according to the embodiment will be described with reference to the drawings. FIG. 3 is a block diagram used for explaining a functional configuration of the distinctive part of the copying machine. The copying machine 1 includes, in addition to the above-mentioned configuration, a density sensor 402, a storing part 403, an adjusting part 404 and an information reading part 405.

The density sensor 402 is provided to each of the development devices 16*a*, 16*b*, 16*c* and 16*d*. In the following, each of the development devices 16*a*, 16*b*, 16*c* and 16*d* will be described as the development device 16. The density sensor 402 measures density of the toner contained in the development device 16. As an example, the density sensor 402 measures the toner density on the basis of measurement of magnetic permeability inside the development device 16.

The storing part 403 stores information relating to a replacement rate in a case where kinds of a first toner and a second toner are different from each other. The first toner is a toner contained in the development device 16. That is, the first toner is a toner that is previously supplied from the toner cartridge 5*a*, 5*b*, 5*c* or 5*d* to the development device 16, and then, already contained in the development device 16. In the following, each of the toner cartridges 5*a*, 5*b*, 5*c* and 5*d* will be described as the toner cartridge 5. The second toner is a toner being supplied from the toner cartridge 5. That is, the second toner is a toner that is newly supplied from the toner cartridge 5 to the development device 16 by replacing a toner cartridge 5 (a first toner cartridge) containing the first toner with another toner cartridge 5 (a second toner cartridge) containing the second toner. Here, as the difference between the first toner and second toner, for example, the first toner is a commonly used toner, but the second toner is another toner being compatible with the first toner.

The replacement rate is a rate of a replaced toner when the first toner contained in the development device 16 is replaced by the second toner. That is, the replacement rate is a rate of a replaced toner in the development device 16 when the first toner contained in the development device 16 is consumed and the development device 16 is replenished with the second toner. For example, the replacement rate is acquired on the basis of a color difference (ΔE). The replacement rate is acquired on the basis of a color difference (ΔE1) between a first image and a second image and another color difference (ΔE2) between a third image and the second image. The first image is an image when the toner image based on the first toner is transferred on the sheet T. The second image is an image when the toner image based on the second toner is transferred on the sheet T. The third image is an image when the toner image based on the first toner and second toner is transferred on the sheet T. The third image is the image when the toner image is formed by a toner mixed by the first toner and second toner and the toner image is transferred on the sheet T. Concretely, the replacement rate is determined by an expression of 100−((ΔE1/ΔE2)*100).

The replacement rate is acquired according to a printing rate as proportion of forming the image on the sheet T by transferring the toner image to the sheet T, temperature and humidity of environment in which the copying machine 1 is arranged or density of the toner contained in the development device 16. FIG. 4 is a table showing as an example the replacement rate according to the printing rate and the number of sheets on which the image has been formed. FIG. 5 is a table showing as an example a correction value of the replacement rate according to the temperature and humidity. FIG. 6 is a table showing as an example a correction value of the replacement rate according to a ratio (a toner/carrier ratio or a T/C ratio) of the toner to the carrier.

A concrete example of the replacement rate acquired on the basis of the color difference is illustrated as shown in FIG. 4. Here, a condition when the replacement rate shown in FIG. 4 is determined will be described as follows. That is, the printing rate is 10-100 percent, the environment is a laboratory environment, the number of the image formed sheets (the integrated number of the image formed sheets) is one hundred and a quantity of the first toner contained in the development device 16 is 16 grams. When the printing rate is 10 percent, 40 milligrams of the toner is consumed. When the printing rate is small and the number of the image formed sheets is small, it is understood from FIG. 4 that the replacement rate is small. When the printing rate is large and the number of the image formed sheets is large, it is understood from FIG. 4 that the replacement rate is large. If the printing rate or the number of the image formed sheets is not illustrated in FIG. 4, not-shown replacement rate can be determined by calculation proportional to the replacement rate now illustrated in FIG. 4.

The replacement rate is corrected according to the temperature and humidity of the copying machine 1. The correction value according to the temperature and humidity is illustrated in FIG. 5. When the temperature is low and the humidity is low, the correction value is determined so as to make the replacement rate smaller. When the temperature is high and the humidity is high, the correction value is determined so as to make the replacement rate larger.

The replacement rate is corrected according to the T/C ratio of the toner and carrier contained in the development device 16. The T/C ratio is a ratio of weight of the toner and weight of the carrier contained in the development device 16, when the developer contained in the development device 16 consists of two components. The correction value according to the T/C ratio is illustrated in FIG. 6. The T/C ratio is acquired on the basis of the toner density measured by the density sensor 402. When the T/C ratio is small, the correction value is determined so as to make the replacement rate smaller. When the T/C ratio is large, the correction value is determined so as to make the replacement rate larger.

The adjusting part 404 adjusts density of the toner image on the basis of the replacement rate stored in the storing part 403, when the toner cartridge 5 containing the first toner is replaced by the other toner cartridge 5 containing the second toner. The adjusting part 404 is actualized, for example, by a central processing unit (a CPU) arranged in the copying machine 1.

The information reading part 405 reads given information from the memory arranged in the toner cartridge 5. The given information is, for example, information relating to kind of the toner contained in the cartridge 5. The information reading part 405 transmits the given information to the adjusting part 404 after the given information is read from the toner cartridge 5. The adjusting part 404 decides the kinds of the toner contained in the toner cartridge 5 arranged in the copying machine 1 on the basis of the given information.

An adjustment of the density of the toner image is actualized, for example, by adjusting the development bias or adjusting the T/C ratio. That is, the adjusting part 404 adjusts the development bias applied to the development device 16 on the basis of the replacement rate, thereby adjusting the density of the toner image. The development bias is bias voltage applied to the developing roller 150 from the voltage applying part 401. The adjusting part 404 controls the voltage applying part 401 to adjust the bias voltage applied to the developing roller 150 from the voltage applying part 401.

The bias voltage is adjusted by adding voltage (voltage value) illustrated as an example in FIG. 7 to usual bias voltage. FIG. 7 is a table showing as an example the adjustment value of a development bias (the bias voltage). The bias voltage is adjusted so as to be maximized when the replacement rate shown in FIG. 4 is 50-60 percent. In this case, the adjustment value of the bias voltage is +50 volt. On the other hand, the bias voltage is adjusted so as to be minimized when the replacement rate shown in FIG. 4 is the smallest or the largest. In this case, the adjustment value of the bias voltage is 0 volt or +10 volt. The adjustment value (the voltage) illustrated as an example in FIG. 7 is determined by carrying out experiments or the like in advance. Information relating to the adjustment value is stored in the storing part 403.

Therefore, the adjusting part 404 acquires the adjustment value of the bias voltage by referring to information relating to the adjustment value of the bias voltage stored in the storing part 403 on the basis of the printing rate determined on the basis of image information and the number of the image formed sheets (the integrated number of the image formed sheets), when the copying machine 1 forms the image on the sheet T on the basis of the image information. The adjusting part 404 adds the acquired adjustment value to the usual bias voltage, thereby determining corrected bias voltage. The adjusting part 404 controls the voltage applying part 401 so that the corrected bias voltage is applied to the developing roller 150 from the voltage applying part 401. Thereby, the density of the image formed on the sheet T is deepened and the density of the image is evened regardless the number of the image formed sheets.

Figure 8:
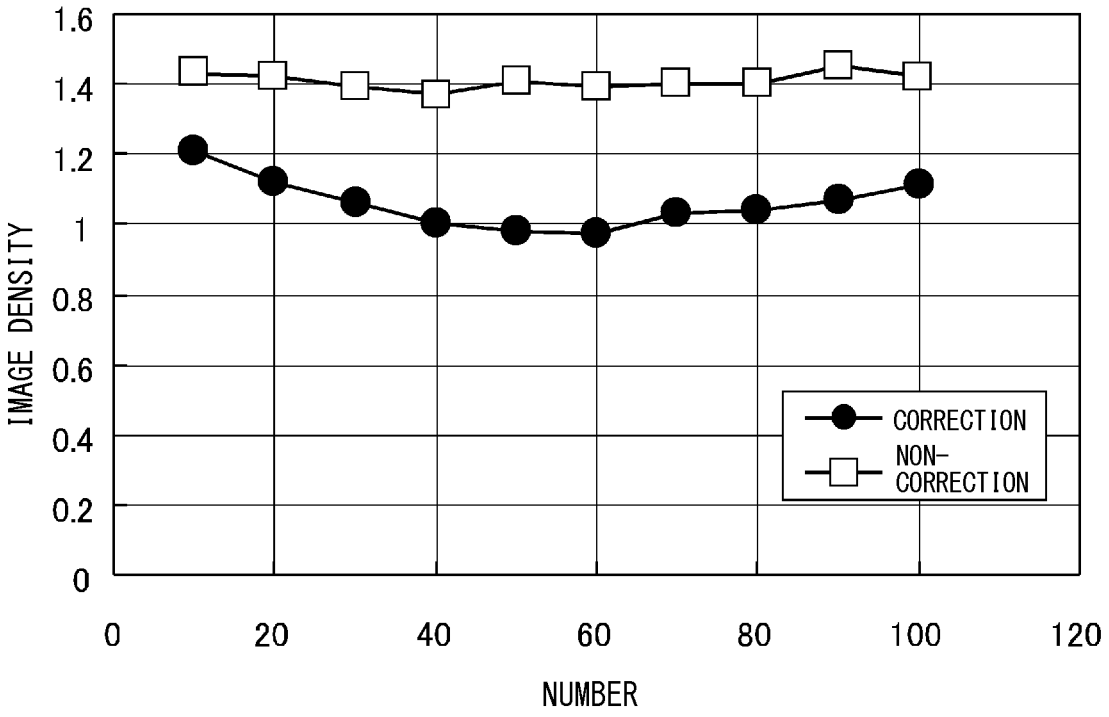
FIG. 8 is a first graph plotting relationships of image density and the number of the sheets on which the image is formed.

FIG. 8 is a first graph plotting relationships of the image density and the number of the image formed sheets (the integrated number of the image formed sheets). In FIG. 8, a vertical axis indicates the image density and a horizontal axis indicates the number of the image formed sheets. FIG. 8 illustrates an experiment result in a case where the printing rate is 50 percent and the temperature and humidity in experiment environment are respectively 20 degrees and 30 percent.

For example, the image density is determined as follows. As a measuring method of the image density, there are a reflection density measuring method and a transmission density measuring method. Here, the reflection density measuring method is used. The image density is determined by a reflected light when a light is given to solid patch with one hundred percent printed on an ejected paper. The reflected light is reduced as the image density is deep.

Plots of "CORRECTION" in FIG. 8 indicate an experiment result in a case where the adjusting part 404 adjusts the bias voltage applied to the developing roller 150 from the voltage applying part 401. Plots of "NON-CORRECTION" in FIG. 8 indicate another experiment result in another case where the above-mentioned adjustment of the bias voltage by the adjusting part 404 is not carried out. It is understood from FIG. 8 that the image density in a case of the "CORRECTION" is evened regardless the number of the image formed sheets. Thereby, in the case of the "CORRECTION", a quality of the image formed on the sheet T is stabilized. By contrast, in another case of the "NON-CORRECTION", the image density is decreased when the number of the image formed sheets is fifty to sixty, but the image density is increased when the number of the image formed sheets becomes smaller or larger. Thereby, in the other case of the "NON-CORRECTION", a quality of the image formed on the sheet T is not stabilized.

Alternatively, the adjusting part 404 may adjust the density of the toner image by adjusting a ratio (the T/C ratio) of the toner contained in the development device 16 and the carrier mixed with the toner on the basis of the replacement rate instead of adjustment of the bias voltage (the development bias).

FIG. 9 is a table showing as an example an adjustment value of the T/C ratio. The T/C ratio is adjusted by adding the adjustment value illustrated as an example in FIG. 9 to usual T/C ratio. The T/C ratio is adjusted so as to be maximized when the replacement rate shown in FIG. 4 is 50-60 percent. In this case, the adjustment value of the T/C ratio is +2.5 percent. On the other hand, the T/C ratio is adjusted so as to be minimized when the replacement rate shown in FIG. 4 is the smallest or the largest. In this case, the adjustment value of the T/C ratio is 0 percent or +0.5 percent. The adjustment value illustrated as the example in FIG. 9 is determined by carrying out experiments or the like in advance. Information relating to the adjustment value is stored in the storing part 403.

Therefore, the adjusting part 404 acquires the adjustment value of the T/C ratio by referring to information relating to the adjustment value of the T/C ratio stored in the storing part 403 on the basis of the printing rate based on the image information and the number of the image formed sheets (the integrated number of the image formed sheets), when the copying machine 1 forms the image on the sheet T on the basis of the image information. The adjusting part 404 adds the acquired adjustment value to the usual T/C ratio, thereby determining corrected T/C ratio. The adjusting part 404 acquires the T/C ratio (a present T/C ratio) relating to the toner contained in the development device 16 on the basis of the density measured by the density sensor 402. The adjusting part 404 controls the toner supply part 6 to supply the toner from the toner cartridge 5 to the development device 16 so that the present T/C ratio becomes equal to the corrected T/C ratio. Thereby, the density of the image formed on the sheet T is deepened and the density of the image is evened regardless the number of the image formed sheets.

Figure 10:
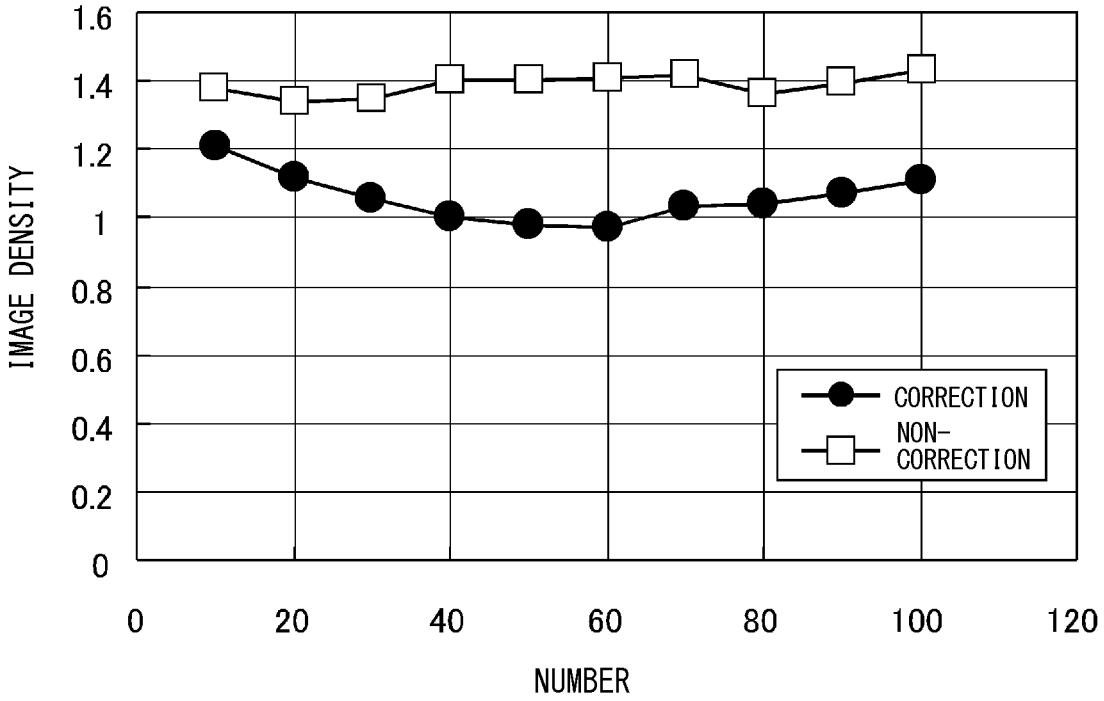
FIG. 10 is a second graph plotting relationships of the image density and the number of the sheets on which the image is formed.

FIG. 10 is a second graph plotting relationships of the image density and the number of the image formed sheets (the integrated number of the image formed sheets). In FIG. 10, a vertical axis indicates the image density and a horizontal axis indicates the number of the image formed sheets. FIG. 10 illustrates an experiment result in a case where the printing rate is 50 percent the temperature and humidity in experiment environment are respectively 20 degrees and 30 percent. Plots of "CORRECTION" in FIG. 10 indicate an experiment result in a case where the adjusting part 404 adjusts the T/C ratio. Plots of "NON-CORRECTION" in FIG. 8 indicate another experiment result in another case where the above-mentioned adjustment of the T/C ratio by the adjusting part 404 is not carried out. It is understood from FIG. 10 that the image density in a case of the "CORRECTION" is evened regardless the number of the image formed sheets. Thereby, in the case of the "CORRECTION", a quality of the image formed on the sheet T is stabilized. By contrast, in another case of the "NON-CORRECTION", the image density is decreased when the number of the image formed sheets is fifty to sixty, but the image density is increased when the number of the image formed sheets becomes smaller or larger. Thereby, in the other case of the "NON-CORRECTION", a quality of the image formed on the sheet T is not stabilized.

As described above, in accordance with the copying machine 1 of the embodiment, the following advantages can be attained. That is, the copying machine 1 of the embodiment adjusts the density of the toner image on the basis of the replacement rate, when the toner cartridge 5 containing the first toner is replaced by the other toner cartridge 5 containing the second toner. Thereby, in the copying machine 1, it is possible to stabilize the quality of the image formed on the sheet T even if the first toner and second toner are mixed in the development device 16.

The copying machine 1 adjusts the density of the toner image by adjusting the development bias applied to the development device 16 on the basis of the replacement rate. In the copying machine 1, it is possible to achieve stabilization of the quality of the image formed on the sheet T by adjusting the development bias.

The copying machine 1 adjusts the density of the toner image by adjusting the T/C ratio on the basis of the replacement rate. In the copying machine 1, it is possible to achieve stabilization of the quality of the image formed on the sheet T by adjusting the T/C ratio.

The replacement rate is acquired on the basis of the color difference between the first image and second image and the other color difference between the third image and second image. That is, the replacement rate is acquired on the basis of the image formed on the sheet T by using the first toner and second toner. Therefore, it is possible to determine a value of the replacement rate as a value adapted to an actual situation.

The replacement rate is acquired according to the printing rate as proportion of forming the image on the sheet T, the temperature and humidity of the copying machine 1 or the density (the T/C ratio) of the toner contained in the development device 16. Thereby, it is possible to determine a value of the replacement rate as a value adapted to an environment in which the copying machine 1 is arranged or a condition for forming the image.

The disclosure is not restricted to the above-mentioned embodiment, but can be actualized by other various embodiments. Although the copying machine 1 is a color copying machine, the copying machine is not restricted to such a machine, but can be a monochrome copying machine. In addition, although, in the copying machine 1, an indirect transfer system is applied to transfer the toner image on the sheet T via the intermediate transferring belt 7, the copying machine is not restricted to such a system, but a direct transfer system can be applied to directly transfer the toner image formed on the photosensitive drum on the sheet T. Moreover, although the copying machine 1 has a configuration being capable of the duplex printing to the sheet T, the copying machine is not restricted to such a configuration, but can have another configuration for a simplex printing.

The image forming apparatus of the disclosure is not restricted to the above-mentioned copying machine 1. That is, the image forming apparatus of the disclosure may be a multifunction machine having a copy function, a facsimile function, a printer function and a scanner function, a facsimile or a printer. In the image forming apparatus of the disclosure, the substance to be transferred, to which the toner image is fixed, is not restricted to the sheet T, but may be, for example, a film sheet, such as an overhead projector (OHP) sheet.

While the present disclosure has been described with reference to the preferable embodiment of the image forming apparatus of the disclosure and the description has technical preferable illustration, the disclosure is not to be restricted by the embodiment and illustration. Components in the embodiment of the present disclosure may be suitably changed or modified, or variously combined with other components. The claims are not restricted by the description of the embodiment.

What is claimed is:

1. An image forming apparatus comprising:

an image carrier including a surface on which a toner image is formed by developing an electrostatic latent image formed on the surface by a toner;

a developing part containing the toner supplied from a toner cartridge and supplying the contained toner to the image carrier;

a storing part storing information relating to a replacement rate of a replaced toner when a first toner contained in the developing part is replaced by a second toner in a case where kinds of the first toner as a toner contained in the developing part and the second toner as another toner being supplied from the toner cartridge are different from each other, the replacement rate being determined by an expression of $100-((\Delta E1/\Delta E2)*100)$, on the basis of:

a color difference $\Delta E1$ between a first image, in a case where a toner image on the basis of the first toner is transferred to a sheet, and a second image, in another case where another toner image on the basis of the second toner is transferred to the sheet, and another color difference $\Delta E2$ between a third image, in a further case where a further toner image on the basis of the first toner and second toner is transferred to the sheet, and the second image; and an adjusting part adjusting density of the toner image on the basis of the replacement rate stored in the storing part when a toner cartridge containing the first toner is replaced by another toner cartridge containing the second toner.

2. The image forming apparatus according to claim 1, wherein the replacement rate is acquired according to a printing rate as proportion of forming an image on the sheet by transferring the toner image to the sheet, temperature and humidity of environment in which the image forming apparatus is arranged, or density of the toner contained in the developing part.

3. The image forming apparatus according to claim 1, wherein the adjusting part adjusts density of the toner image by adjusting a development bias applied to the developing part on the basis of the replacement rate.

4. The image forming apparatus according to claim 1, wherein the adjusting part adjusts density of the toner image by adjusting a ratio of the toner contained in the developing part and a carrier mixed with the toner.

5. The image forming apparatus according to claim 3, wherein the adjusting part adjusts the development bias so as to be maximized when the replacement rate is 50-60 percent.

6. The image forming apparatus according to claim 4, wherein the adjusting part adjusts the ratio of the toner to the carrier so as to be maximized when the replacement rate is 50-60 percent.

* * * * *